United States Patent [19]

de los Santos

[11] Patent Number: 4,993,301

[45] Date of Patent: Feb. 19, 1991

[54] JAGGED EDGE PICK FOR A STRINGED MUSICAL INSTRUMENT

[75] Inventor: Federico E. de los Santos, 2068 E. Libra Dr., Tempe, Ariz. 85283

[73] Assignee: Federico E. de los Santos, Tempe, Ariz.

[21] Appl. No.: 525,337

[22] Filed: May 16, 1990

[51] Int. Cl.[5] ..... G10D 3/16
[52] U.S. Cl. ..... 84/322
[58] Field of Search ..... 84/322

[56] References Cited

U.S. PATENT DOCUMENTS

| | | | |
|---|---|---|---|
| 526,221 | 9/1894 | Connery | 84/322 |
| 2,459,274 | 1/1949 | Galetzky | 84/322 |
| 2,484,820 | 10/1949 | Galetzky | 84/322 |
| 3,312,137 | 4/1967 | Oddo | 84/322 |

*Primary Examiner*—Lawrence R. Franklin

[57] ABSTRACT

A guitar pick having a serrated or jagged edge for picking a guitar string and capable of producing in a rapid succession a repetitive tone to give a percussive effect and to alternatively pick normally by using the unserrated top portion of the pick. The serrations may be on a beveled surface, may extend along about a ½ inch of the length of the guitar pick and be on both sides of the pick.

20 Claims, 1 Drawing Sheet

JAGGED EDGE PICK FOR A STRINGED MUSICAL INSTRUMENT

This invention relates to picks for stringed musical instruments such as guitars, mandolins or the like and more particularly to a pick having a serrated picking surface capable of producing a unique sound from electric guitars.

BACKGROUND

Electric guitars are normally played with a hand held pick that has been made from a variety of materials and with a number of shapes over the years. From time to time changes have been made to provide unique sounds or other acoustic effects.

Oddo U.S. Pat. No. 3,312,137 is representative of a pick having a pair of pick blades secured together to provide a multiple sound or tone each time the string of the instrument is struck with a pick blade. Serrations are disclosed on an edge of a single blade to be used for picking the strings. These serrations have rounded corners and are disclosed as being effective to produce a tremolo effect of each note struck from the string.

SUMMARY OF THE INVENTION

It is an object of the present invention to provide a novel pick construction for a stringed instrument.

It is a further object to provide a guitar pick having a jagged or serrated picking edge that is effective to create a unique sound. The sound is generated through conventional electronic circuitry connected to an electric guitar and is characterized by yielding a rough, percussive texture to the note played.

It is yet a further object to provide a pick having serrations on a beveled edge, preferably oriented so that the direction of the picking stroke is perpendicular to the peaks of the serration. By proper location of the serrated surfaces on only a portion of the pick, the pick may be used to provide both a unique sound and a conventional sound depending upon the portion of the pick being used. By providing the serrations on opposite faces of the pick for the two picking surfaces, the desired sound can be obtained on both an up-pick stroke and down-pick stroke.

These and other objects of the invention will become more fully apparent from the claims and from the description as it proceeds in connection with the drawings.

DETAILED DESCRIPTION OF THE EMBODIMENTS

The present invention will be described in conjunction with a pick of a size and shape conventionally used with electric guitars plugged in a digital delay (e.g. 200 milliseconds) and a stereo chorus (depth $\frac{1}{3}$, rate $\frac{3}{4}$). The purpose of this shape given the portion of the pick which engages the guitar string during picking is to produce a unique guitar sound that is clean and without distortion and is similar to a sound that has been made popular by an entertaining group. The single repetitive note produces a sound which is very percussive, i.e. it has a rough percussive texture, and is unlike the traditional sounds expected from an electric guitar. This unusual sound is largely due to the configuration of the pick since the guitar and its associated equipment are unchanged.

Figure 1:
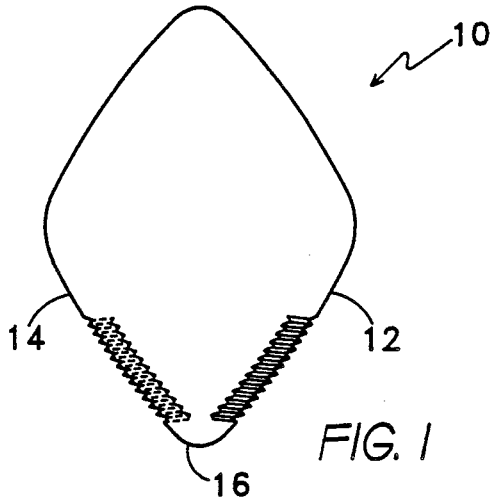
FIG. 1 is a plan view of a pick which embodies the present invention.

A pick 10 of standard size is illustrated in FIG. 1 and may have a length of about 1 inch, more or less, with angularly disposed edges 12 and 14 converging at a rounded tip as shown at 16. Picks made of plastic come in gauges having thicknesses which vary between about 1 mm to about 0.5 mm. The length of edges 12 and 14 that is used for picking strings of a stringed instrument usually does not exceed about 0.5 inch and is shown in cross hatched lines in FIG. 1.

To obtain the percussive texture to the note played, this invention involves the use of a jagged or serrated edge which has a large number of peaks and valleys so that as a note is struck, a large number of peaks, at least 6 and preferably 10 to 20, strike the string in rapid sequence. To this end, at least one of the active picking edges 12 or 14 is provided with a row of at least 6 peaks that are closely spaced. The peak to peak distance preferred is about 1/25 inch although the distance may vary. The spacing is accomplished by providing edge 12 or 14 with 10 to 15 peaks that are separated by a sufficient distance to give a percussive sound during a single stroke in a single direction. The peak to peak spacing is preferably uniform, but uniformity is not critical.

The serrated edge can be achieved in any suitable fashion. Files, saws and the like can be used to modify an existing pick, or the picks can be made of metal or molded of a plastic material and the serrated surface formed during the manufacturing process.

Figure 3:
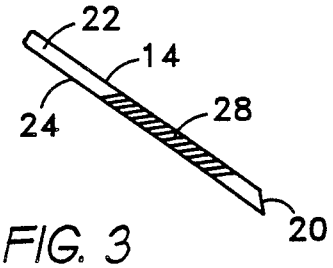
FIG. 3 is an edge view taken along a different edge of FIG. 1.
Figure 2:
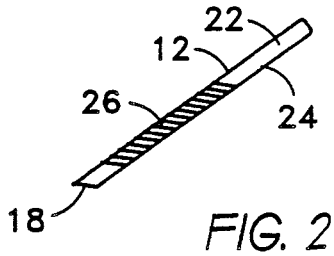
FIG. 2 is an edge view taken along an edge of FIG. 1.

In a preferred form of the pick, the serrations are formed on a beveled edged surface 18, 20 that is illustrated in FIGS. 2 and 3 and coextensive with the length of the picking surface. The beveled surface 18, 20 may make an angle of about 45° with the central plane of the pick that is midway between the upper face 22 and the back face 24. The peaks of the serrations 26, 28 form generally parallel lines 32 (FIGS. 4 and 5) having a direction which is angled as is indicated by the angle $\theta$ relative to a line 34 that is perpendicular to the central plane as is illustrated in FIG. 5. Lines 32 are generally parallel to the direction to the string during a stroke action. The most comfortable position of the pick for most guitar players suggests that the angle $\theta$ should be between about 30° and 45°.

By proper orientation of the direction of peaks 32 a maximum percussive effect can be achieved by tilting the pick when striking a string. On the other hand, a smooth picking surface as illustrated in FIG. 1 may be provided when the pick position in the hand of the player is reversed allowing conventional picking.

When making a mold for the pick, it is sufficient to form about 12 of the saw teeth 32 along about $\frac{1}{2}$ inch, although a greater length of the pick edge surface could be made jagged or serrated if desired. In one embodiment, a valley mid-way between peaks is readily obtained when using a triangular file on an existing pick. I prefer to provide a saw tooth shape having a vertical wall 38 join to a wall 36 having a slope of about 45° to make an angle of about 45° with the vertical wall 34. This gives a depth that is appropriate when the spacing between adjacent peaks is about 1/25 inch.

Figure 4:
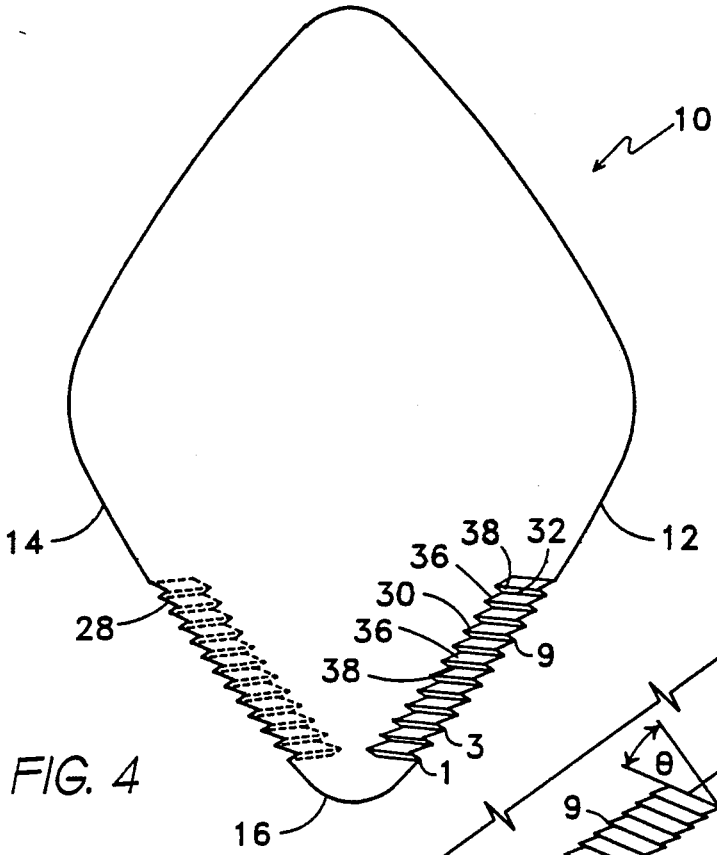
FIG. 4 is a view similar to FIG. 1 but to an enlarged scale showing serrations on a plane beveled at about 45°.
Figure 5:
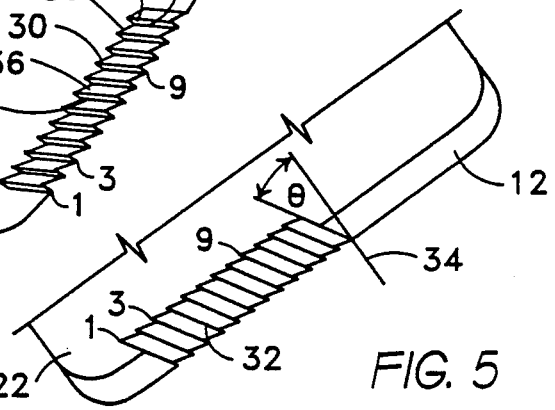
FIG. 5 is a view of an edge of the pick of FIG. 4 taken in a direction looking directly at the beveled plane.

If the peaks are patterned to follow the peripheral line of an edge 12 or 14 as illustrated in FIG. 1, then the picking surface on one face of the pick remains only slightly roughened thereby allowing different amplitudes of the percussive effect to be achieved by merely reversing the pick face that is used. Because the upper end is not serrated, the pick may be used to obtain a conventional sound by reversal of the ends of the pick being used.

Where it is desired to have the percussive effect of the serrated edge both on an up-pick stroke and a down-pick stroke, a second identical serrated edge surface may be formed also on the under face 24 as shown in FIGS. 1, 3 and 4. This picking or contact area of the pick on the up-pick stroke is on the back face 24 opposite the front face 22 which carries the picking contact area on edge 12 on the down-pick stroke.

By use of the pick of the present invention, a guitar player can achieve the effect of picking the same note very fast making it possible to play 32nds, 64ths and 128th notes. This is to be distinguished from prior art pick structures having two or three picking points and from prior art picks where a tremolo effect is achieved.

The foregoing description is to be considered as being illustrative and not limiting. All changes and modifications which fall within the scope of the appended claims and equivalents thereof are intended to be covered.

What is claimed:

1. A pick having substantially parallel faces on opposite sides of a central plane with two angularly disposed picking edges converging to form an end used for picking strings of a stringed instrument, said pick having:

each of said two edges being defined by an edge of a beveled surface;

one of said beveled surfaces extending from a first face through the central plane toward a second face and the other of said beveled surfaces extending from the second face through the central plane toward the first face; and peaks and valleys forming a jagged surface on each of said beveled surfaces and being arranged so that by holding the pick in one playing position, beveled surfaces on opposite faces engage a string of a stringed instrument during both an up-pick stroke and a down-pick stroke to provide a first sound and by holding a pick in a second reversed playing position, a different second sound is provided by the same two angularly disposed edges.

2. The pick as defined in claim 1 wherein the angle of the beveled surfaces relative to the central plane is about 45°.

3. The pick as defined in claim 1 wherein said jagged surfaces extend along at least about ½ inch of a picking length of said edges and include at least six closely spaced peaks which produce a percussive sound effect.

4. The pick as defined in claim 3 wherein the peaks are separated by valleys with the spacing between adjacent peaks being about 1/25 inch.

5. The pick as defined in claim 4 wherein the profile of said jagged edges includes at least 10 peaks that follow the contour of said angularly disposed edges with the peaks being part of a sawtooth pattern.

6. The pick as defined in claim 4 wherein the peaks comprise a plurality of parallel edges that are angled relative to a line perpendicular to said central plane and generally parallel to the string during a stroking action.

7. A pick having substantially parallel faces on opposite sides of a central plane with two angularly disposed edges converging to form a pointed end used for picking strings of a stringed instrument;

a first of said edges being beveled on one of said faces along a stroking length to form a surface that is angularly related to said central plane and serrated along the beveled surface to produce a first sound effect; and said first edge on the other of said faces having serrations of a lesser depth and effective to produce a second contrasting sound effect.

8. The pick as defined in claim 7 wherein the beveled surface has an angle of about 45° relative to said central plan.

9. The pick as defined in claim 7 wherein the serrations are spaced at a substantially uniform distance of about 1/25 inch.

10. The pick as defined in claim 9 wherein the serrations extend along a stroking length of about ½ inch.

11. A pick having a substantially parallel faces on opposite sides of a central plane with two angularly disposed edges converging to form an end used for picking strings of a stringed instrument, at least one of said edges having serrations with peaks separated at a uniform spacing of about 1/25th inch and extending along an edge length of about ½ inch.

12. The pick as defined in claim 11 wherein both of said angularly disposed edges contain substantially identical serrations.

13. The pick as defined in claim 11 wherein both of said angularly disposed edges are beveled to provide on each edge a surface that is angularly related to said central plan and serrations are on both of said surfaces.

14. The pick as defined in claim 11 wherein the profile of a second end of the pick is smooth and useable to produce a conventional sound.

15. A pick having substantially parallel faces on opposite sides of a central plane with two angularly disposed picking edges converging to form an end used for picking strings of a stringed instrument, one of said picking edges having at least six sharp edged peaks that extend from one of said faces to the other of said faces and valleys between the peaks, said peaks and valleys extending along a stroking length of the picking edge and being capable of producing a rough textured sound during a single picking stroke.

16. The pick as defined in claim 15 wherein the serrations have adjacent peaks separated at uniform spacings which extend along an edge length of at least about ½ inch.

17. The pick as defined in claim 16 wherein the sharp edged peaks have a sawtooth shape with one surface of the sawtooth being at substantially a right angle with respect to a profile of said picking edge and another surface of said sawtooth being at about 45° with respect to said picking edge profile.

18. A jagged edge pick for a stringed instrument having two picking edges disposed at substantially a right angle with respect to each other and joined by a rounded end, said pick being characterized by having on at least one picking edge between 10 and 15 peaks separated by intervening valleys which extend along at least about ½ inch of said picking edge thereby to produce a percussive sound during a single picking stroke.

19. The pick as defined in claim 18 wherein adjacent peaks on said peaks are spaced apart by about 1/25th inch.

20. The pick as defined in claim 18 characterized further by having a beveled surface along at least one of said picking edges and the peaks and valleys are on said beveled surface with a peripheral edge of the beveled surface being sufficiently smooth so as to produce a conventional sound when the pick is held in one position.

* * * * *